United States Patent [19]

Fishman

[11] Patent Number: 5,029,375

[45] Date of Patent: Jul. 9, 1991

[54] METHOD OF FABRICATING A STRINGED INSTRUMENT PIEZOELECTRIC TRANSDUCER

[76] Inventor: Lawrence R. Fishman, 76 Grove St., West Medford, Mass. 02155

[21] Appl. No.: 552,984

[22] Filed: Jul. 16, 1990

Related U.S. Application Data

[60] Division of Ser. No. 251,570, Sep. 30, 1988, Pat. No. 4,944,209, which is a continuation-in-part of Ser. No. 876,238, Jun. 19, 1986, Pat. No. 4,774,867, which is a continuation-in-part of Ser. No. 856,189, Apr. 28, 1986, abandoned.

[51] Int. Cl.[5] ..... H04R 17/00; G10H 3/18

[52] U.S. Cl. ..... 29/25.35; 29/169.5; 84/731; 84/DIG. 24; 310/321; 310/328; 310/340

[58] Field of Search ..... 29/25.35, 169.5; 84/730–732, DIG. 24; 310/321, 328, 340

[56] References Cited

U.S. PATENT DOCUMENTS 4,727,634 3/1988 Fishman ..... 29/25.35

*Primary Examiner*—Stanley J. Witkowski

*Attorney, Agent, or Firm*—Wolf, Greenfield & Sacks

[57] ABSTRACT

A transducer for a stringed musical instrument incorporating an electrically conductive ground plane, along with a plurality of piezoelectric transducers and a conductive strip. The ground plane, piezoelectric transducers and conductive strip are secured in an elongated unitary structure with the ground plane and conductive strip disposed on opposite sides of the transducers. A conductive shield is disposed about the unitary structure and electrical leads connect to the ground plane and conductive strip, respectively.

6 Claims, 5 Drawing Sheets

METHOD OF FABRICATING A STRINGED INSTRUMENT PIEZOELECTRIC TRANSDUCER

BACKGROUND OF THE INVENTION

1. Field of the Invention

The present invention relates in general to a musical instrument transducer, and pertains, more particularly, to a piezoelectric transducer used with a stringed musical instrument and preferably for use with a guitar.

2. Background Discussion

At the present time, the prior art shows a variety of electromechanical transducers employing piezoelectric materials such as described in U.S. Pat. No. 3,325,580 or U.S. Pat. No. 4,491,051. Most of there piezoelectric transducers are not completely effective in faithfully converting mechanical movements or vibrations into electrical output signals which precisely correspond to the character of the input vibrations. This lack of fidelity is primarily due to the nature of the mechanical coupling between the driving vibratile member and the piezoelectric material. Some of these prior art structures such as shown in U.S. Pat. No. 4,491,051 are also quite complex in construction and become quite expensive to fabricate.

Accordingly, it is an object of the present invention to provide an improved piezoelectric transducer particularly for use with a stringed musical instrument such as a guitar.

Another object of the present invention is to provide an improved transducer as in accordance with the preceding object and which provides for the faithful conversion of string vibrations into electrical signals that substantially exactly correspond with the character of such vibrations.

Still a further object of the present invention is to provide an improved musical instrument transducer as in accordance with the preceding objects and which is relatively simple in construction, can be readily fabricated and which can also be constructed relatively inexpensively.

Another object of the present invention is to provide an improved musical instrument transducer that is readily adapted for retrofit to existing stringed instruments without requiring any substantial modification thereto.

SUMMARY OF THE INVENTION

To accomplish the foregoing and other objects, features and advantages of the invention, there is provided a transducer for a stringed musical instrument that is adapted to be positioned adjacent the instrument strings to receive acoustic vibratory signals therefrom. The transducer comprises an electrically conductive ground plane, a plurality of piezoelectric transducers, each preferably of substantially disc-like shape and adapted to be aligned with an instrument string, and a conductive strip. In an alternate embodiment of the invention the piezoelectric transducers may be of square or rectangular shape. The ground plane is a thin elongated metal sheet preferably of berylium copper and having a right angle end tab. The ground plane may also be of other conductive material such as brass. Each piezoelectric transducer preferably comprises a piezoelectric crystal having a circular shape. In accordance with one version of the present invention, the crystal diameter is on the order of 1/16th inch and the crystal thickness is on the order of 0.020 inch. The conductive strip is preferably comprised of a circuit board including a dielectric baseboard carrying a conductive cladding that defines the conductive strip. There is also preferably provided a resilient electrically conductive layer disposed between the transducer and conductive strip. This conductive layer is preferred to be of carbon fiber. Means are provided for securing the ground plane, piezoelectric transducers, and conductive strip in an elongated unitary structure with the transducers disposed between the ground plane and conductive strip and spacedly disposed so as to be in alignment with respective strings. In a preferred embodiment of the invention the piezoelectric crystals are bonded to a carbon fiber strip in order to properly align the crystals. The bonding of the crystals on only one face also provides some crystal defamation so as to increase the voltage level of the output signal. A conductive shield is disposed about the unitary structure. Electrical contact is provided between the shield and the ground plane and furthermore electrical leads connect to the ground plane and conductive strip which in turn provides electrical continuity to opposite sides of the crystals. The electrical leads include a first electrical lead soldered to the ground plane and a second electrical lead soldered to the conductive cladding.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 1:
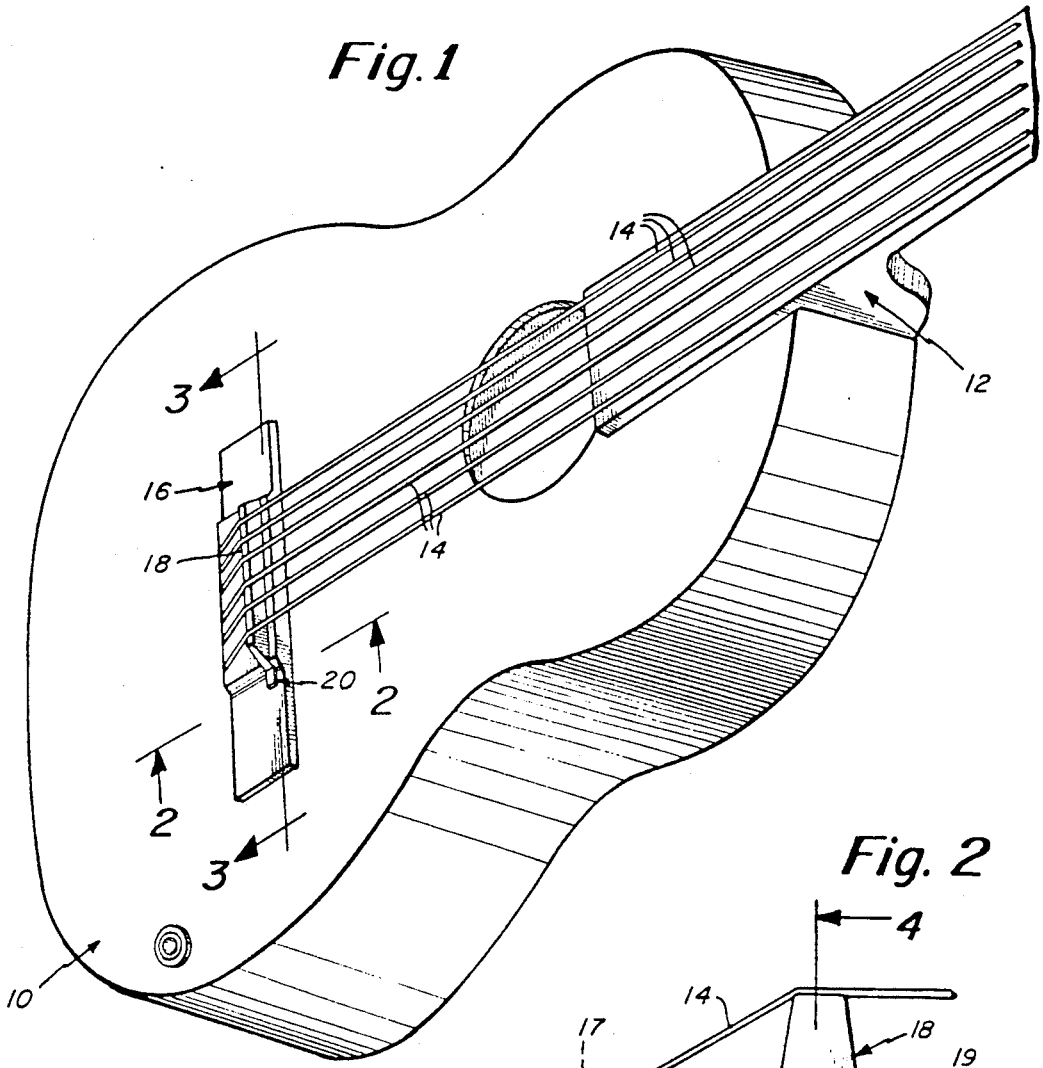
FIG. 1 is a perspective view of a stringed musical instrument and in particular a guitar that has incorporated therein the transducer of the present invention.
Figure 2:
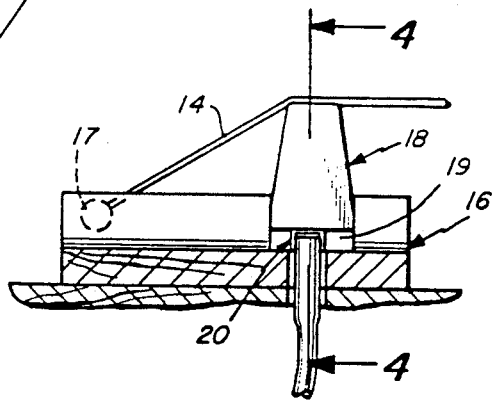
FIG. 2 is a cross-sectional view taken along line 2—2 of FIG. 1.
Figure 3:
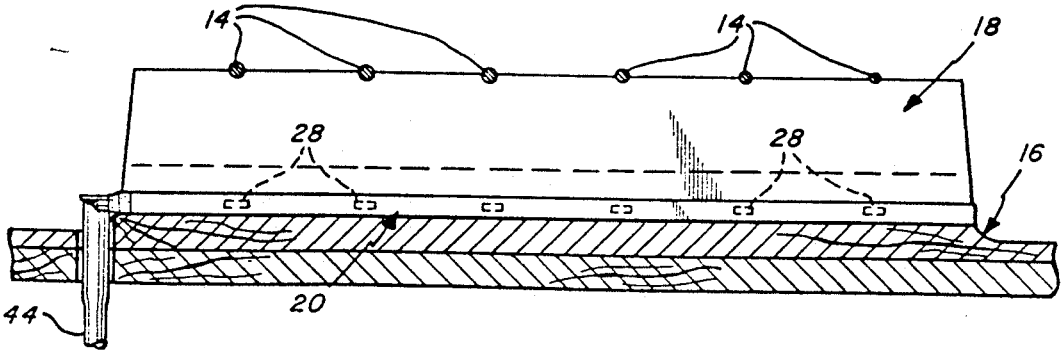
FIG. 3 is a cross-sectional view taken along line 3—3 of FIG. 1 and illustrating the placement of individual crystals relative to the strings.

Reference is now made to the drawings and in particular to FIGS. 1-3. FIG. 1 illustrates a quitar that is comprised of a guitar body 10 having a neck 12 and supporting a plurality of strings 14. In the embodiment disclosed herein, such as illustrated in FIG. 3, there are six strings 14. The strings 14 are supported at the neck end of the instrument, but are not illustrated herein. At the body end of the strings, the support is provided by means of the bridge 16. The bridge 16 includes means, such as illustrated in FIG. 2 for securing the end 17 of each of the strings 14.

The bridge 16 is slotted such as illustrated in FIG. 2 in order to receive the saddle 18. The strings 14 are received in notches in the saddle 18 at the top surface thereof.

In an existing instrument, in order to install the transducer 20 of the present invention, the tension on the strings 14 is removed and the saddle 18 can then be lifted out of the slot in the bridge. The transducer 20 is then inserted in this slot 19. The saddle 18 may then be cut at its bottom end to remove a portion thereof. The portion removed is approximately equal to the height of the transducer 20 so that when the saddle 18 is reinstalled (see FIG. 2) then the saddle will assume the same height above the bridge.

Figure 4:
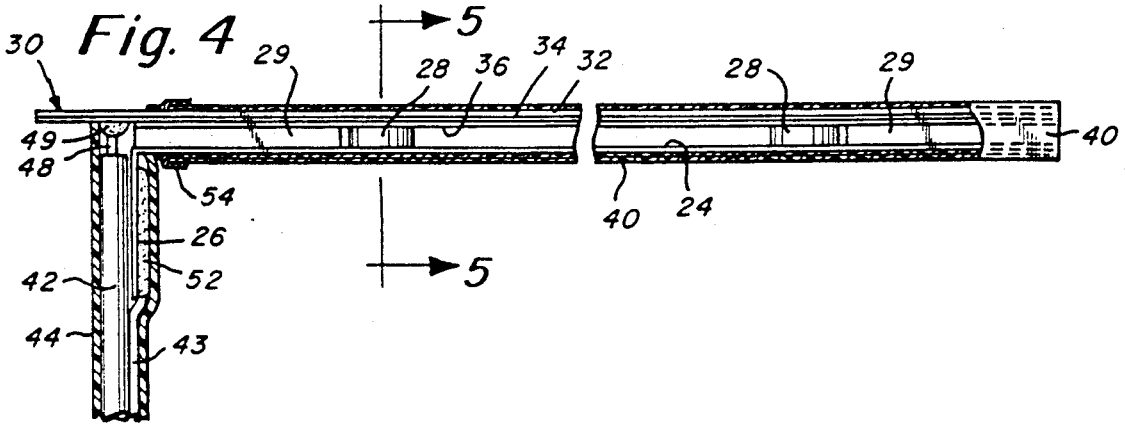
FIG. 4 is a cross-sectional view taken along line 4—4 of FIG. 2 illustrating further details of the musical instrument transducer.
Figure 5:
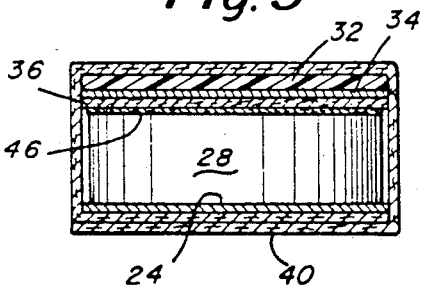
FIG. 5 is a cross-sectional view taken along line 5—5 of FIG. 4 through one of the crystals.
Figure 6:
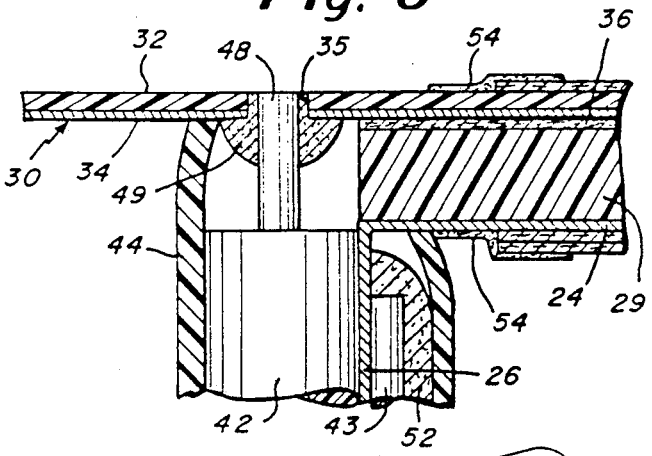
FIG. 6 is a more detailed cross-sectional view showing the portion of the transducer wherein the input leads connect.
Figure 7:
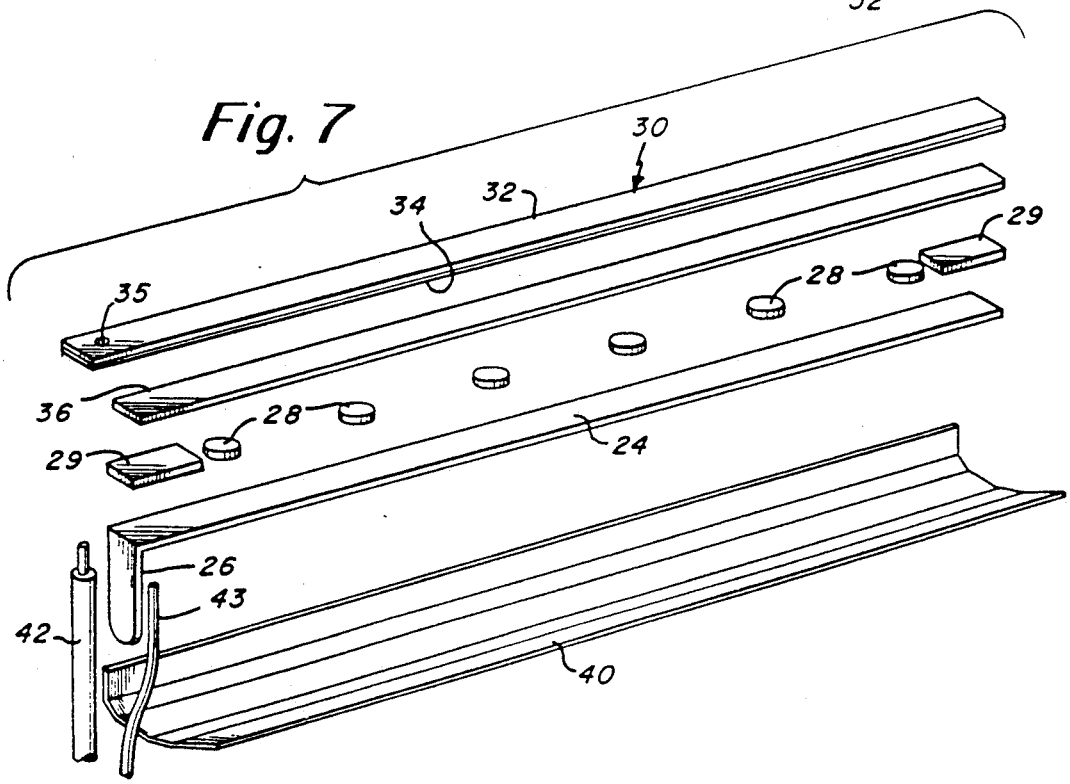
FIG. 7 is an exploded perspective view illustrating the different components that comprise the transducer of the invention.
Figure 8:
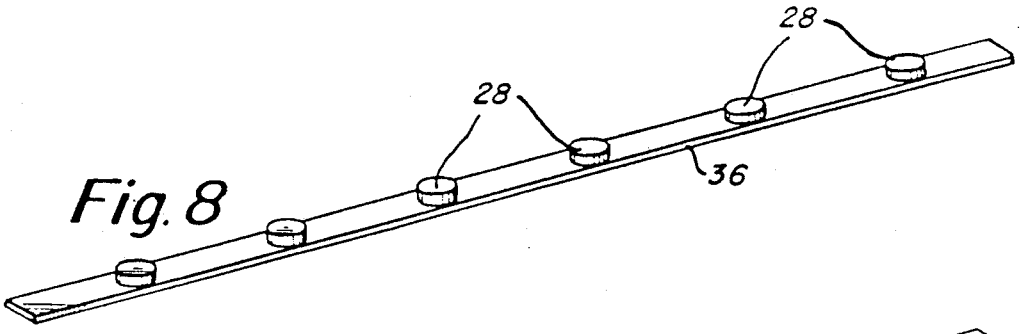
FIGS. 8-12 illustrate sequential assembly steps in the constructing the musical instrument transducer of this invention.

With regard to the further details of the transducer 20, reference is furthermore made to FIGS. 4-7. In particular, FIG. 7 is an exploded perspective view illustrating the individual components that comprise the transducer. FIG. 6 shows specific details of the connection of the electrical leads to the transducer. FIG. 3 illustrates the specific placement of the piezoelectric crystals as they relate to the strings 14.

The ground plane 24 may alternatively be constructed of a different metal such as brass. The ground plane 24 provides a contact to one side of each of the plurality of piezoelectric crystals 28. As indicated previously, these crystals 28 are disposed in a spaced relationship as indicated in FIG. 3. In this regard, with reference to the crystals 28, it is noted that they are of the disc-shape as illustrated, and in one embodiment are of 1/16th inch diameter by 0.020 inch thick. The electrodes of each crystal are at the respective top and bottom surfaces thereof. Thus, contact to the crystal occurs through the ground plane 24 by virtue of the ground plane contacting the lower electrode of each of the transducers.

The other conductive contact to each of the individual transducers is provided by a conductive strip defined by the elongated circuit board 30. The circuit board 30 includes a dielectric epoxy fiberglass layer 32 having a copper clad layer 34 deposited thereon. It is also noted that the circuit board 30 has a hole 35 at one end thereof for providing a solder connection. In this regard, refer to the detailed cross-sectional view of FIG. 6.

The transducer 20, such as depicted in FIG. 7, also includes a resilient and electrically conductive layer 36 that is disposed adjacent the top side of each of the crystals 28. The layer 36 is conductive and provides electrical conductivity along with the necessary resiliency between the crystals 28 and the copper cladding 34.

A reference has been made herein to the piezoelectric crystals 28. These are illustrated as being of disk or circular shape but could likewise be of other form such as square or rectangular. Although reference has been made to these devices as being piezoelectric crystals a more technically accurate term is piezoelectric ceramic. A crystal usually refers to a single crystal structure such as quartz. However, the materials employed herein are amorphous structures containing many thousand individual crystals. They are constructed by combining different elements in their powder form and subjecting them to high temperatures which forms a fused ceramic containing thousands of crystals. They are then subjected to high DC voltages which tends to align a majority of the dipoles and thus gives the enure structure a common polarity.

In FIG. 7 there is shown the wrapping paper 40. This is preferably a parchment having a high linen content. This is preferably 100% rag paper that provides a complete wrapping about the transducer such as illustrated in the cross-sectional view of FIG. 5. The paper 40 is painted with a nickel-filled colloid (paint). This colloid provides a shield about the transducer and in an alternate embodiment, instead of being a nickel-filled colloid may be filled with any conductor such as graphite or copper. This combination of a parchment type paper along with the nickel-filled colloid (paint) provides an extremely effective shield about the transducer and provides it in a relatively simple manner. In addition to providing an extremely effective shield, the combination of paper and paint rapping represent a substantial improvement over prior shielding techniques such as described in U.S. Pat. No. 4,491,051. Because the paper is a dielectric itself there are no shorting problems. This arrangement also eliminates the need for an additional layer of insulating material that definitely is necessary when using a metal foil such as in U.S. Pat. No. 4,491,051.

Finally, in FIG. 7 there are illustrated the end spacers 29 which are preferably of a dielectric material and which may be made of a compressible material. Also disclosed are a pair of leads 42 and 43 that connect respectively to the circuit board 30 and the ground plane 34 as will be described in further detail hereinafter.

As indicated previously, the crystals 28 are of relatively small size and are provided with electrodes on the top and bottom surface thereof. It has been found that a circular type of crystal is better than a rectangular shaped one. With the rectangular crystal, there are edge effects that interfere with proper signal transduction. Such edge effects are substantially reduced by the use of circular crystals.

FIG. 4 is a cross sectional view showing the spaced crystals and furthermore illustrating the ground plane 24 and its associated tab 26. FIG. 4 also illustrates the connection of the electrical leads to the transducer. This includes the leads 42 and 43. The lead 43 is soldered to the tab 26. The lead 42 couples to the solder hole 35 for connection to the circuit board 30.

FIG. 5 is a cross-sectional view taken along line 5—5 of FIG. 4 showing the different layers that comprise the transducer. It is noted in FIG. 5 that there is also illustrated, a conductive adhesive layer 46 that attaches the crystal 28 to the carbon fiber layer 36. It is noted in FIG. 5 that an adhesive layer is only provided on one side of the crystal 28 thus bonding the crystal on only one side thereof. A discussion follows hereinafter regarding the advantages of such bonding technique. FIG. 5 also clearly illustrates the wrapping of the outer shield formed by the essential single wrapping of the paper 40.

FIG. 6 is a detailed cross-sectional view showing in particular the connection of the electrical leads to the transducer. In this regard it is noted that the leads 42 and 43 have a plastic shrink tubing 44 extending thereover. The lead 42 has its center conductor 48 soldered at 49 to the circuit board 30, to in particular provide a conductive connection to the cladding 34. As indicated previously, the lead 43 has its conductor soldered as at 52 to the tab 26 of the ground plane 24. FIG. 6 illustrates one embodiment for providing conductivity between the shield and ground plane. This is illustrated with a conductive paint 54 which it is noted provides electrical conductivity from the shield to the ground plane. The paint is applied so that there is no electrical conductivity to the circuit board. In this regard refer also to the preferred form of providing conductivity as illustrated and described hereinafter in FIGS. 13A and 13B.

Figure 9:
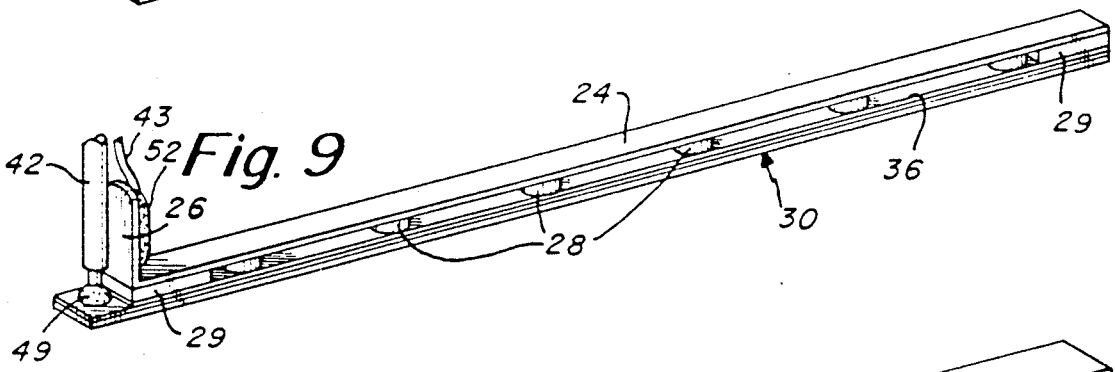
Figure 10:
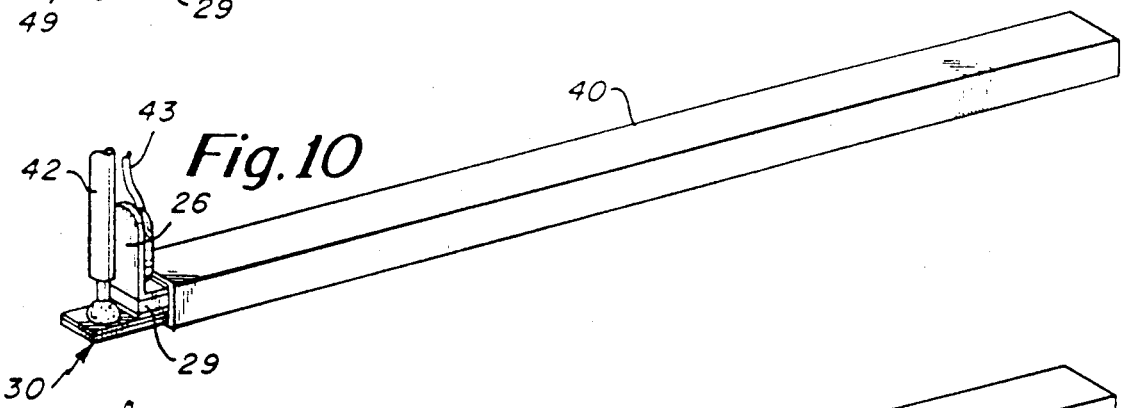
Figure 11:
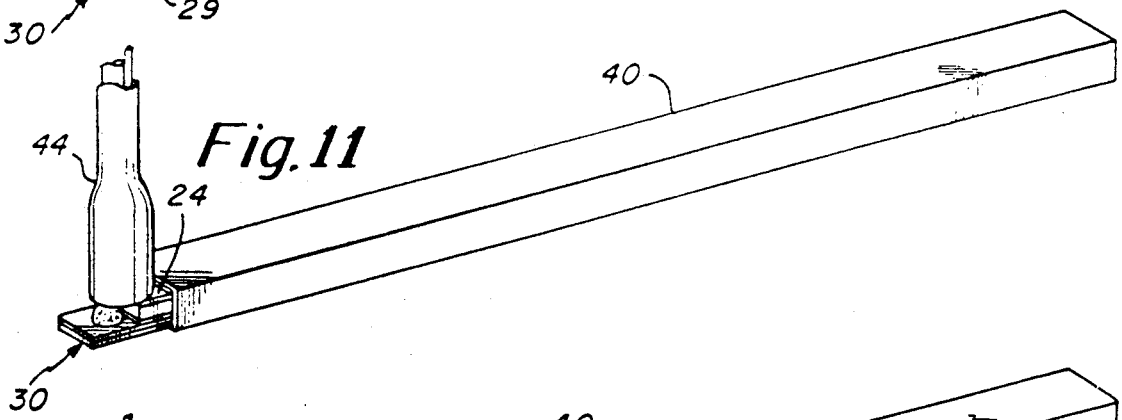
Figure 12:
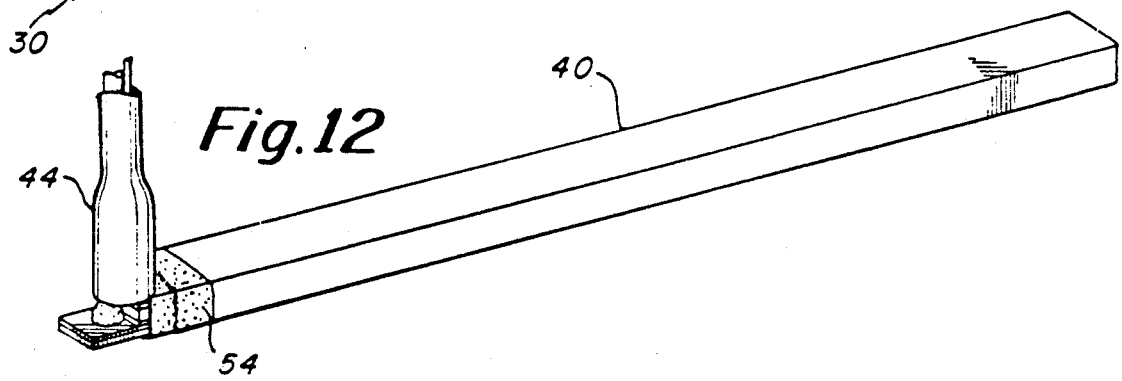

FIGS. 8–12 show the sequence of steps in constructing the device of the present invention. First, the piezoelectric crystals 28 are secured to the carbon fiber strip 36 by a conductive epoxy, illustrated in FIG. 5 as the conductive layer 46. The crystals 28 are spaced in the manner illustrated in FIG. 3 relative to string spacing. The electrical leads 42 and 43 may then be soldered to the circuit board 30 and the tab 26 and the circuit board 30 and ground plane 24 along with the spacers 29 are then formed into a unitary structure as illustrated in FIG. 9. The paper jacket 40 is then wrapped about the structure leaving the leads 42 and 43 exposed as indicated in FIG. 10. FIG. 11 then illustrates the heat shrink tube 44 disposed over the leads 42 and 43. Finally, in FIG. 12 the paper is painted with the conductive nickel paint in a manner to provide conductive connection to the ground plane, but no conductivity to the circuit board.

Figure 13A:
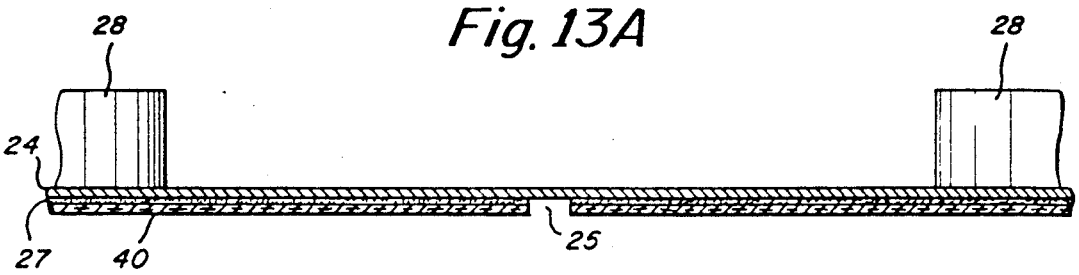
FIGS. 13A and 13B illustrate sequential assembly steps for a preferred embodiment of providing electrical contact from the ground plane to a shield.
Figure 13B:
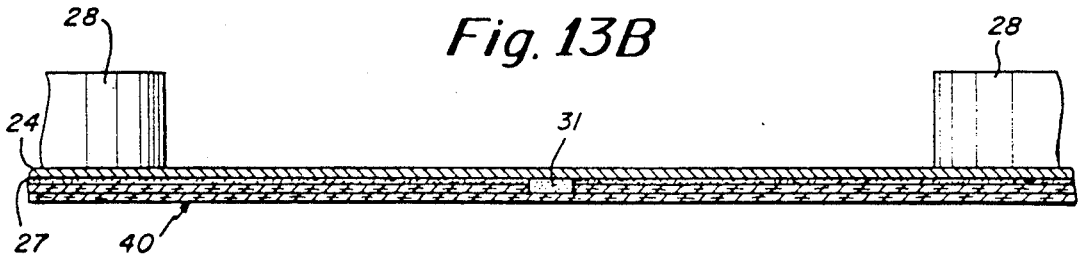

Reference has been made hereinbefore to one technique of grounding the shield to the ground plane 24. However, a preferred technique is now described in FIGS. 13A and 13B. In FIGS. 13A and 13B the same reference characters will be used as previously referred to.

Although the technique of FIG. 6 is satisfactory one problem is that the conductive paint 54 provides a bump at the top and bottom of the device. This makes it more difficult to have flat full face contact between the top of the device and the saddle, and between the bottom of the device and the bridge slot.

Thus, with reference to FIG. 13A there is shown a fragmentary view illustrating the transducers 28 resting upon but not bonded to the ground plane 24. A small hole illustrated at 25 is punched through the painted paper 40. The ground plane 24 is attached to the inside of the paper 40 with an adhesive as illustrated in FIG. 13A at 27. The adhesive 27 is preferably not used in the area where the hole is provided. The hole is then filled with conductive paint 31 as illustrated in FIG. 13B. This provides a conductive path in the outside of the paper and the ground plane 24. FIG. 13B then shows an additional layer of paper. The paper is wrapped into a tube about the device and is sealed with an adhesive. In this connection it is noted that the paper when processed in the fabrication step has already been painted with the metal filled colloid. And thus the conductive paint 31 is applied this may fill the hole and also overlap to contact the metal paint to provide the proper conductivity between the shield and ground plane.

Reference has been made herein before to the fact that each of the piezoelectric crystals 28 are bonded only on one side to a relatively rigid member which in the disclosed embodiment is the carbon fiber strip 36. This has been illustrated previously in FIG. 8. The ground plane 24 on the other side of the crystals is not bonded to the crystals and thus the crystals are only bonded on one side. A carbon fiber strip has been chosen as the preferred form although other conductive metal materials may also be employed. The described method of construction provides a unitary structure (carbon fiber strip/crystals) that is held in a somewhat sliding configuration with regard to the ground plane and the conductive strip. This provides a very flexible structure that can readily bend and conform to any irregularities in the slotted bridge.

The bonding of the crystals to the carbon fiber strip provides a way to maintain the proper crystal location with regard to the strings yet have the crystals relatively isolated. This is a clear improvement over prior art techniques described in U.S. Pat. No. 4,491,051. In that patent they maintain crystal location by employing spacers between the crystals. This is undesirable because of the side-to-side contact between the crystals and the spacers.

Because the crystals are sensitive to vibration in the shear mode as well as in the compressive mode, any undesirable vibrations, such as instrument body noise, which may create vibrations in the lateral direction are thus translated to all of the crystals which in turn add them to the output signal. In the case of isolated crystals, these lateral vibrations are not picked up, and the resulting output is a much clearer representation of the actual string vibrations. In this regard note, for example, in FIG. 4 of the present application as well as in FIGS. 7 and 9 that there is a clear void space between each of the crystals 28.

The bonding of the crystals on only one face also provides an increase of voltage level to the output signal. As the crystal is compressed it tends to deform. Since only one surface is restricted by the bond, the resulting deformation causes bending to occur at the bonded surface. This bending stresses the entire surface and thus adds to the overall output voltage. The resulting signal is larger than that of an unbonded crystal under simple compression.

Figure 14:
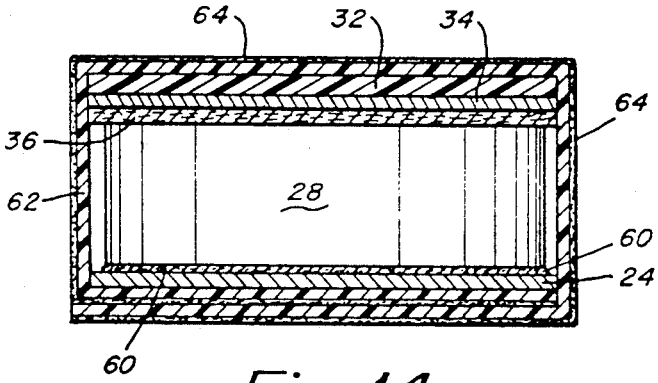
FIG. 14 is a cross-sectional view through an alternate construction of the transducer in which the piezoelectric crystals are bonded to the ground plane and in which the shield is provided by a thin plastic sheet having a metal vapor deposited thereon.

Reference is now made to FIGS. 14–10 for an illustration of further alternate embodiments of the present invention. The cross-sectional view of FIG. 14 is similar to that of FIG. 5, but in the embodiment of FIG. 14 the piezoelectric crystal is secured to the ground plane rather than to the carbon fiber layer 36. In the embodiments of FIGS. 15–20 there is basically illustrated the use of heat-shrink tubing for forming an electrical shield and various alternate techniques for application thereof. In FIGS. 14–20 the same reference characters are used to identify similar components previously identified in the earlier embodiments described herein.

FIG. 14 illustrates a cross-sectional view of an alternate form of the transducer of the present invention. The cross-sectional view of FIG. 14 is similar to that previous described in connection with FIG. 5. In this embodiment, there is illustrated the circuit-board 30 comprised of a fiber layer 32 and copper-clad layer 34. Also illustrated is the carbon fiber layer 36. In this embodiment of the invention, rather than having the piezoelectric crystals 28 secured to the layer 36, they are instead secured to the ground plane 24. For this purpose, there is illustrated in FIG. 14 the conductive adhesive layer 60, which may be a conductive epoxy. It is noted that this layer is disposed between the piezoelectric crystal 28 and the ground plane 24.

FIG. 14 also illustrates an alternate form of the electrical shield for the device. Rather than providing the structure illustrated in FIGS. 5 and 7, the shield is constructed, in the embodiment of FIG. 14, in the form of a thin plastic layer 62 that may be, for example, relatively thin Mylar. There is deposited on the outer surface of the layer 62 a thin metal layer 64. This may be formed by a metal vapor deposition process. The layer may be a thin layer of, for example, copper or aluminum. The shield may be coupled to, for example, the round plane 24, in a similar manner to that described in earlier embodiments, such as that illustrated in FIGS. 13*a* and 13*b*.

In the embodiment of FIG. 14, it is noted that the layer 60 is only provided on one side of the crystal 28, thus bonding the crystal 28 on only one side thereof. As indicated previously, this has an advantage regarding enhanced transducer output. It is thus noted in FIG. 14 that no adhesive layer appears at the top of the crystal between the crystal 28 and the layer 36.

Figure 15:
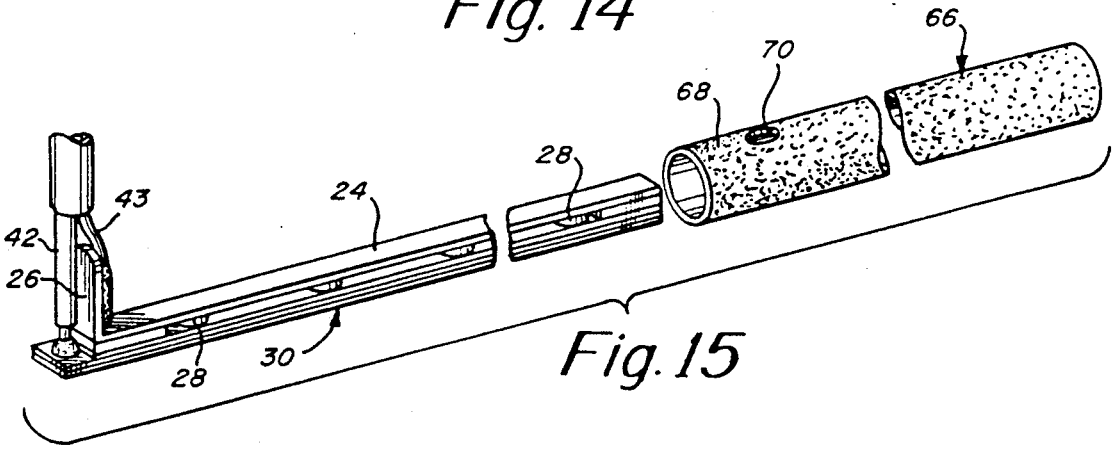
FIG. 15 is an exploded perspective view showing an alternate shield construction employing a heat shrink tube and associate conductive ink or paint.

Reference is now made to the perspective view of FIG. 15. In FIG. 15 the transducer construction is illustrated as previously described. Basically illustrated in FIG. 15 is the circuit board 3 and the plurality of piezoelectric crystals 28. FIG. 15 also shows the ground plane 24 with its and tab 26 and the leads 42 and 43.

Also illustrated in FIG. 15 is the heat shrink tubing 66 illustrated in this embodiment as having disposed over the outer surface thereof a conductive ink paint 68. At one end of the tubing 66 is a hole 70 that will provide electrical conductivity from the conductive ink layer 68 to the ground plane 24. In this regard, reference is made hereinafter to, for example, FIGS. 17 and 18 to show the manner in which conductivity is intercoupled between the shield and the ground plane.

Figure 16:
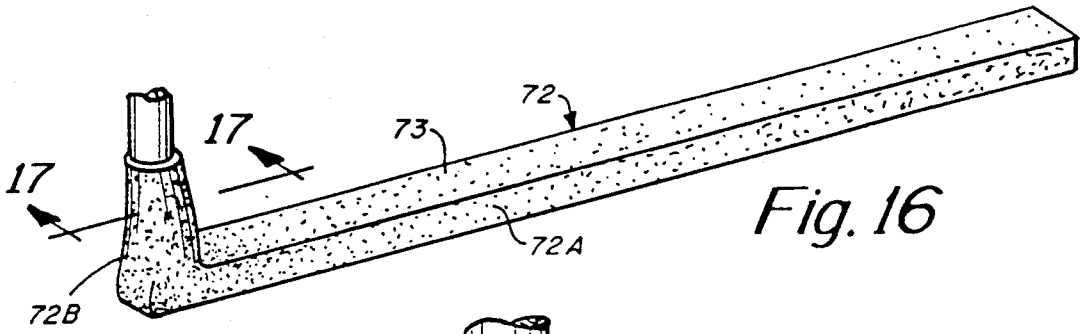
FIG. 16 is a perspective view illustrating the heat-shrink tubing extending about the entire transducer structure and extending at a right angle at one end where the lead connects.

Reference is now made to the perspective view of FIG. 16, which illustrates a heat shrink tubing 72 after heat is applied thereto. FIG. 16 also shows the outer conductive ink coating at 73. In the particular arrangement of FIG. 16, the heat shrink tubing is basically in two sections, including an elongated linear section 72*a* and a right-angled end section 72*b* that is adapted to fit up over the leads. FIG. 16 shows the tubing after having been heat-shrunk to be firmly disposed about the transducer unitary structure.

Figure 17:
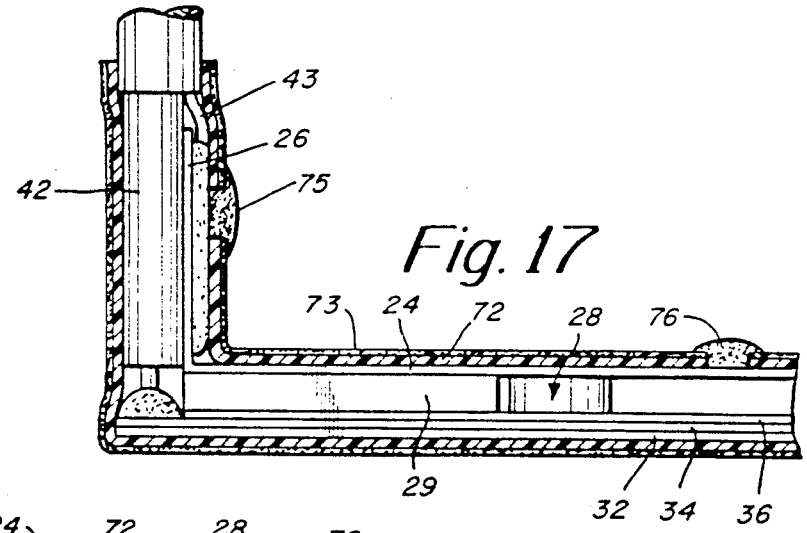
FIG. 17 is a cross-sectional view taken along line 17—17 of FIG. 16 in an embodiment in which the conductive coating is applied before heat shrinking of the tube.
Figure 18:
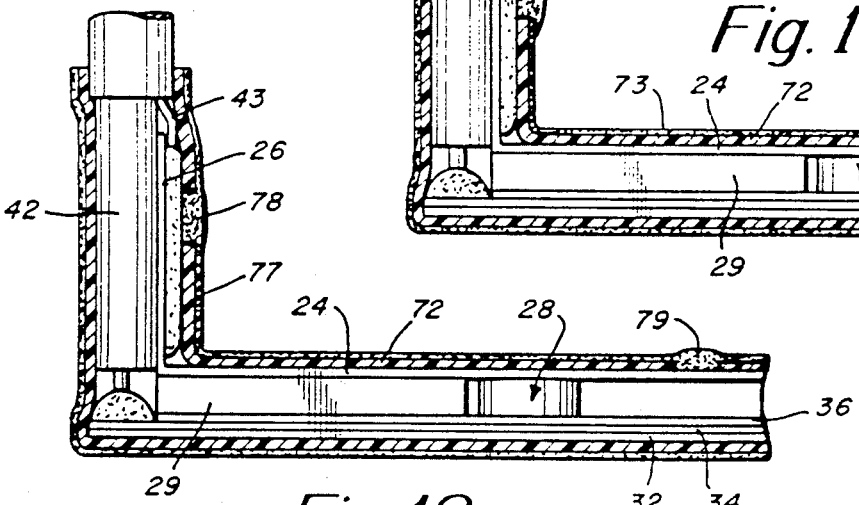
FIG. 18 is a cross-sectional view similar to that shown for FIG. 17, but wherein the conductive coating is applied after the heat-shrinking of the tube.

FIG. 17 is a cross-sectional view taken along line 17—17 of FIG. 16 and showing further details, particularly with regard to the shield and its coupling of electrical conductivity to the ground plane. FIG. 18 is a cross-sectional view similar to that shown in FIG. 17 but for an alternate embodiment of the invention. Basically, in FIG. 17 the conductive coating is applied to the heat-shrink tubing before the tubing is heat-shrunk. In the embodiment of FIG. 18, the conductive coating is applied after the tubing is heat-shrunk.

Now, in FIG. 17, there is illustrated the heat shrink tubing 72 with the conductive coating 73 applied thereto. This conductive coating may be a conductive ink or a conductive paint applied to the heat-shrink tubing by being painted or sprayed thereon. As indicated previously, in the embodiment of FIG. 17, the conductive coating is applied before the heat-shrinking. FIG. 17 illustrates the further step of applyinq a conductive epoxy at 75 and 76 to provide conductivity to the ground plane 24. For this purpose a hole is provided in the heat-shrink tubing, such as the aforementioned hole 70 in FIG. 15 and a conductive paint is applied at 75 or 76 to provide proper contact from the shield to the ground plane.

The embodiment of FIG. 18 is similar to that described in FIG. 17 except for the fact that the heat shrink tubing 72 is first heat-shrunk and then the coating is applied thereafter. In FIG. 18 the coating 77 is shown applied and fills holes provided in the heat-shrink tubing such as at 78 and 79. Again, this the necessary electrical conductivity from the outer conductive layer, forming the electric shield, to the ground plane, either directly thereto or by means of coupling through the lead 43 and the tab 26 to the ground plane.

Figure 19:
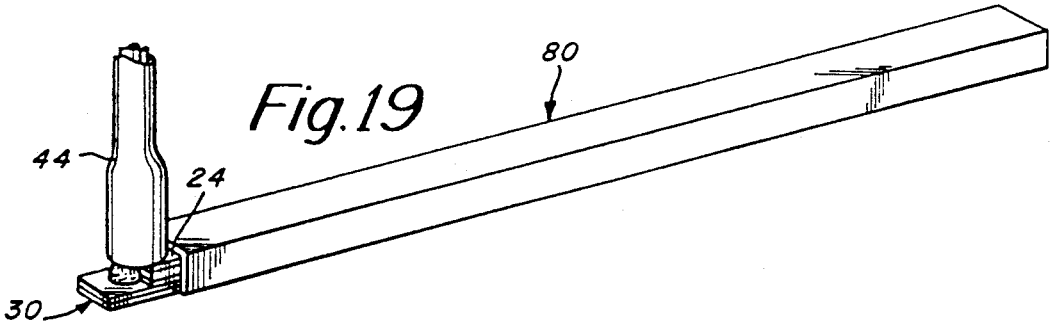
FIG. 19 is a perspective view of an alternate embodiment in which the heat-shrink tubing only extends in a linear path.

Reference is now made to FIG. 19 which is a perspective view of still another embodiment of the present invention in which there is provided a heat-shrink tubing 80 illustrated as having been shrunk about the transducer unitary structure. In this particular embodiment, there is also provided the separate heat shrink tubing 44. In this embodiment, there is not a single tube being used but instead two separate tubing sections, as noted.

Figure 20:
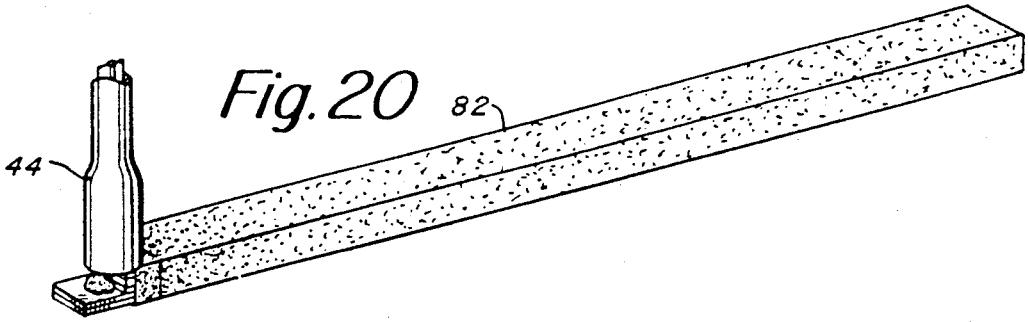
FIG. 20 is a/perspective view showing the next step after that illustrated in FIG. 19, with a coating being applied after heat shrinking.

The perspective view of FIG. 20 indicates the next step in the sequence after the tubing 80 has been heat shrunk around the unitary structure. The next step is to apply a conductive coating such as illustrated at 82 in FIG. 20. To provide continuity with the coating that forms the electric shield and the ground plane, a hole may be provided, as discussed in the earlier embodiments, or, alternatively, electrical continuity can be provided by directly painting from the layer 82 to the exposed portion of the round plane adjacent to the tubing 44.

FIGS. 19 and 20 illustrate an embodiment in which the tubing is first heat-shrunk and then the conductive layer is applied thereafter. In an alternate embodiment of the present invention, in the particular structure illustrated in FIGS. 19 and 20, the tubing may be pre-coated with a conductive paint or ink and then heat-shrunk thereafter. An additional conductive epoxy or the like might then have to be used to provide electrical conductivity between the shield and the ground plane.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A method of fabricating a stringed instrument transducer that is adapted to be positioned adjacent the instrument strings to receive acoustic vibratory signals therefrom, said method comprising the steps of, providing a first electrically conductive member, providing a second electrically conductive member, providing a plurality of piezoelectric crystals, disposing the crystals between the first and second electrically conductive members so as to provide an elongated unitary structure and with the crystals disposed so as to be in alignment with respective strings when installed in the musical instrument, providing a flexible base dielectric layer, vapor depositing a metallic layer on the base dielectric layer, wrapping the base dielectric layer with the metal layer deposited thereon about the unitary structure so as to form an electrical shield about the structure, and connecting electrical leads to the respective first and second electrically conductive members.

2. A method as set forth in claim 1 wherein the step of providing a base dielectric layer includes providing a plastic layer and wherein the step of metal vapor depositing includes vapor depositing one of copper or aluminum.

3. A method of fabricating a stringed instrument transducer that is adapted to be positioned adjacent the instrument strings to receive acoustic vibratory signals therefrom, said method comprising the steps of, providing a first electrically conductive member, providing a second electrically conductive member, providing a plurality of piezoelectric crystals, disposing the plurality of piezoelectric crystals between the first and second electrically conductive members so as to provide an elongated unitary structure and with the crystals disposed so as to be in alignment with respective strings when installed in the musical instrument, providing a heat shrink tubing adapted to be disposed over the unitary structure and depositing a conductive layer over the heat shrink tubing so as to form a shield about the structure, and connecting electrical leads to the respective first and second electrically conductive members.

4. A method as set forth in claim 3 wherein the conductive layer is formed of one of a conductive paint or conductive ink.

5. A method as set forth in claim 3 wherein the heat shrink tubing is first provided, the conductive layer is deposited over the heat shrink tubing, and heat shrink tubing is then inserted over the unitary structure, and the heat shrink tubing is then heated to shrink about the unitary structure.

6. A method as set forth in claim 3 wherein the heat shrink tubing is disposed over the unitary structure and is heat shrunk followed by the deposition of the conductive layer.

* * * * *